US005662404A

United States Patent [19]

Susat

[11] Patent Number: 5,662,404

[45] Date of Patent: Sep. 2, 1997

[54] GARBAGE DISPOSAL VIEWER

[76] Inventor: Richard J. Susat, 11 Conver Dr., Saratoga Springs, N.Y. 12866-9740

[21] Appl. No.: 546,601

[22] Filed: Oct. 23, 1995

[51] Int. Cl.[6] ..... F21V 33/00

[52] U.S. Cl. ..... 362/32; 362/253; 362/191; 294/118

[58] Field of Search ..... 362/32, 234, 253, 362/190, 191, 200, 201; 294/118, 1.1; 241/46.013, 46.014, 46.015, 46.016

[56] References Cited

U.S. PATENT DOCUMENTS

| | | | |
|---|---|---|---|
| D. 266,963 | 11/1982 | Sherman | D32/35 |
| D. 269,302 | 6/1983 | Auerbach | D32/42 |
| 3,510,070 | 5/1970 | Stratman . | |
| 4,268,080 | 5/1981 | Lindley | 294/1.1 |
| 4,519,102 | 5/1985 | Efstratis | 4/292 |
| 4,911,492 | 3/1990 | Ward | 294/118 |
| 4,955,657 | 9/1990 | Ward | 294/118 |

*Primary Examiner*—Thomas M. Sember

[57] ABSTRACT

The present invention relates to a garbage disposal viewer (10) capable of being inserted into garbage disposal cylinder of a garbage disposal positioned within a sink, the garbage disposal viewer (10) functioning to allow a user to view a garbage disposal grinder, the garbage disposal viewer (10) having a viewer (12) which further has: a viewer ring top (12A) having a viewer ring opening (12E) therein and therethrough, a viewer ring bottom (12B) having a similar shape and size of the viewer ring top (12A), the viewer ring bottom (12B) further having viewer ring opening (12E) therein and therethrough, a viewer ring side (12C) circumventionally positioned around and between the viewer ring top (12B) and viewer ring bottom (12B), and a viewer cylinder (12D) extending outwardly from and securely fastened to the viewer ring bottom (12B), the viewer cylinder (12D) having sufficient length to extend beyond and thereby depress a garbage disposal deflector (18B), the viewer cylinder (12D) further comprises an outside diameter slightly smaller than an inside diameter of the garbage disposal cylinder. The garbage disposal viewer (10) has an optional lighting means to faciltate a user in illuminating the inside of the garbage disposal.

9 Claims, 4 Drawing Sheets

GARBAGE DISPOSAL VIEWER

BACKGROUND OF THE INVENTION

1. Field of the Invention

The present invention relates to garbage disposal viewer. More particularly, the present invention relates to a garbage disposal viewer that is capable of both holding the garbage disposal rubber deflector in an open position as well as illuminating the inside of the garbage disposal.

2. Description of the Prior Art

Until the present invention, there have been no prior art apparatus which directly address the problem of visually inspecting the garbage disposal from an installed in a sink position.

Numerous innovations for garbage disposal devices have been provided in the prior art that are described as follows. Even though these innovations may be suitable for the specific individual purposes to which they address, the differ from the present invention as hereinafter contrasted.

In, U.S. Pat. No. 4,519,102, Titled Garbage Disposal Guard, invented by Ernest Efstratis comprises a sleeve having an upper cylindrical wall portion and a lower cylindrical base portion of smaller diameter than the upper wall portion and joined thereto by a shoulder portion. The sleeve is adapted to be installed in the drain of a sink equipped with garbage grinder with its shoulder portion seated on a portion of the sink surrounding the drain, its base portion extending down into the drain and its upper wall portion projecting up above the drain. Slots are provided in the sleeve to permit an adequate flow of water. The slots are sufficiently narrow to prevent flatware and the like from washing down the drain and into the grinder. The sleeve may be longitudinally split to permit it to be circumferentially squeezed or compressed so that it will fit drains of different sizes.

This differs from the present invention in that the attached device is apparently intended to prevent flatware and the like from entering the disposal unit, and can do only that. It does not extend into the disposer throat far enough to depress the rubber deflector. The present invention is intended to provide inspection of the disposer interior, hands free, therefor providing easy retrieval of foreign objects from within (Rings, jewelry, etc.).

In U.S. Pat. No. 3,510,070, titled Garbage Disposal Apparatus. Invented by Jerome F. Stratman, comprises a sink mount for a disposer including a mounting ring on the sink flange assembly at the outlet and a support ring on the upper end of the disposer, with the two having cooperating hook elements which are engaged in the mounting of the disposer to support the latter at this location for upward swinging movement full against the flange assembly. One of the hook elements has appreciable peripheral extent, so that the disposer can be rotatably adjusted, and the mounting ring carries an adjusting and holding screw which engages the support ring and forces the same upwardly against the flange assembly to secure the disposer n place.

This differs from the present invention in that the attached is a device from attaching the disposal unit to sinks, it has no relation to the present invention.

In U.S. Pat. No. 4,268,080, titled Manual Tool for Feeding Refuse To a Garbage Grinder Disposal Invented by William L. Lindley, comprises a manual tool for feeding refuse to a garbage grinder disposal includes a unitary body with a head portion adjacent one end of the body. The head portion is provided with a plurality of spaced, longitudinally extending recess means to define longitudinally extending ribs between the recess means whereby tool may be manually gasped. Shaft means extend longitudinally from the head portion and is of a size for inserting in the garbage grinder disposal, and surface means are provided on the end of the shaft means and project therefrom whereby refuse may be engaged by manual manipulation of the tool and stuffed into the garbage grinder. Surface means on the tool limit the extent the shaft means my be inserted in the garbage grinder deposal.

This differs from the present invention in that this is a refuse feeder only. The present invention is inserted into the disposer to depress rubber deflector and provide hands free internal inspection of disposer unit, allowing retrieval of foreign objects.

In U.S. Pat. No. Des. 269,302, titled Combined Garbage Disposal Plunger and Scraper, invented by Frederick F. Auerbach, is an ornamental design for a combined garbage disposal plunger and scraper. There is no relationship to the above Patent and the present invention.

In U.S. Pat. No. Des. 266,963, titled Garbage Disposal Tool, invented by David L. Sherman, is an ornamental design for a garbage disposal tool.

This differs from the present invention in that it appears to be design for an insert into the disposer which would prevent entry of silverware and the like. This does not depress rubber deflector of disposer to provide hands free inspection of the interior of the disposer unit, and/or retrieval of foreign objects.

Numerous innovations for garbage have been provided in the prior art that are adapted to be used. Even though these innovations may be suitable for the specific individual purposes to which they address, they would not be suitable for the purposes of the present invention as heretofore described.

SUMMARY OF THE INVENTION

The present invention is a garbage disposal viewing device utilized for looking into an installed garbage disposal without the removal thereof. Garbage disposals often jam with debris which must be removed by the user.

The types of problems encountered in the prior art are garbage disposals are difficult to remove to visually inspect. In addition, removal often requires disconnecting of the electrical lines which must be done by a licensed electrician at a tremendous cost to the user.

In the prior art, unsuccessful attempts to solve this problem were attempted namely: plunging and scraping devices. However, the problem was solved by the present invention because it allowed a user to visually inspect a garbage disposal in situ while permitting him to remove the debris therein.

Innovations within the prior art are rapidly being exploited to invent in situ devices for a user to inspect and make repairs to garbage disposals.

The present invention went contrary to the teaching of the art which describes plunging and scraping devices.

The present invention solved a long felt need for user operated repair and inspection devices which decrease consumer maintenance costs of appliances.

Accordingly, it is an object of the present invention to provide a garbage disposal viewer for a in sire garbage disposals.

More particularly, it is an object of the present invention to provide a garbage disposal viewer which is easily installed and removed by a user.

In keeping with these objects, and with others which will become apparent hereinafter, one feature of the present invention resides, briefly stated, in a lighting means removably attachable to the garbage disposal viewer.

When the lighting means is designed in accordance with the present invention, is fiber optic.

In accordance with another feature of the present invention, the lighting means has lens projected light.

Another feature of the present invention is that it has a viewer cylinder which is deep enough to depress a garbage disposal deflector and maintain it in an open position to facilitate viewing.

Yet another feature of the present invention is that it has a viewer ring top with a viewer ring top light source female member therein.

Still another feature of the present invention is that the lighting means has a lighting means bottom male member which is complimentary to the viewer ring top light source female member functioning to securely position the lighting means thereon.

Yet still another feature of the present invention is that the lighting means is battery operated.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

BRIEF LIST OF REFERENCE NUMERALS UTILIZED IN THE DRAWING

10—garbage disposal viewer (10)
12—viewer (12)
12A—viewer ring top (12A)
12AA—viewer ring top light source female member (12AA)
12B—viewer ring bottom (12B)
12C—viewer ring side (12C)
12CA—viewer ring side lifter (12CA)
12D—viewer cylinder (12D)
12E—viewer ring opening (12E)
16—sink (16)
18—garbage disposal (18)
18A—garbage disposal cylinder (18A)
18B—garbage disposal deflector (18B)
18C—garbage disposal grinder (18C)

FIRST LIGHTING MEANS EMBODIMENT

114—first lighting means (114)
114A—first lighting means top (114A)
114B—first lighting means bottom (114B)
114BA—first lighting means bottom lid (114BA)
114BAA—first lighting means bottom lid indica (114BAA)
114BB—first lighting means bottom male member (114BB)
114C—first lighting means side (114C)
114D—first lighting means column (114D)
114DA—first lighting means column top distal end (114DA)
114DB—first lighting means column bottom distal end (114DB)
114E—first lighting means switch (114E)
114F—first lighting means back (114F)
114G—first lighting means fiber optic (114G)
114H—first lighting means battery (114H)
114HA—first lighting means battery electrical contacts (114HA)
114I—first lighting means bulb (1141)

SECOND LIGHTING MEANS EMBODIMENT

214—second lighting means (214)
214A—second lighting means top (214A)
214B—second lighting means bottom (214B)
214BA—second lighting means bottom lid (214BA)
214BAA—second lighting means bottom lid indica (214BAA)
214BB—second lighting means bottom male member (214BB)
214C—second lighting means side (214C)
214D—second lighting means column (214D)
214DA—second lighting means column top distal end (214DA)
214DB—second lighting means column bottom distal end (214DB)
214E—second lighting means switch (214E)
214F—second lighting means back (214F)
214G—second lighting means lens (214G)
214GA—second lighting means lens front angle (214GA)
214H—second lighting means battery (214H)
214HA—second lighting means battery electrical contacts (214HA)
214I—second lighting means bulb (2141)

BRIEF DESCRIPTION OF THE PREFERRED EMBODIMENT

DETAILED DESCRIPTION OF THE PREFERRED EMBODIMENT

Figure 1:
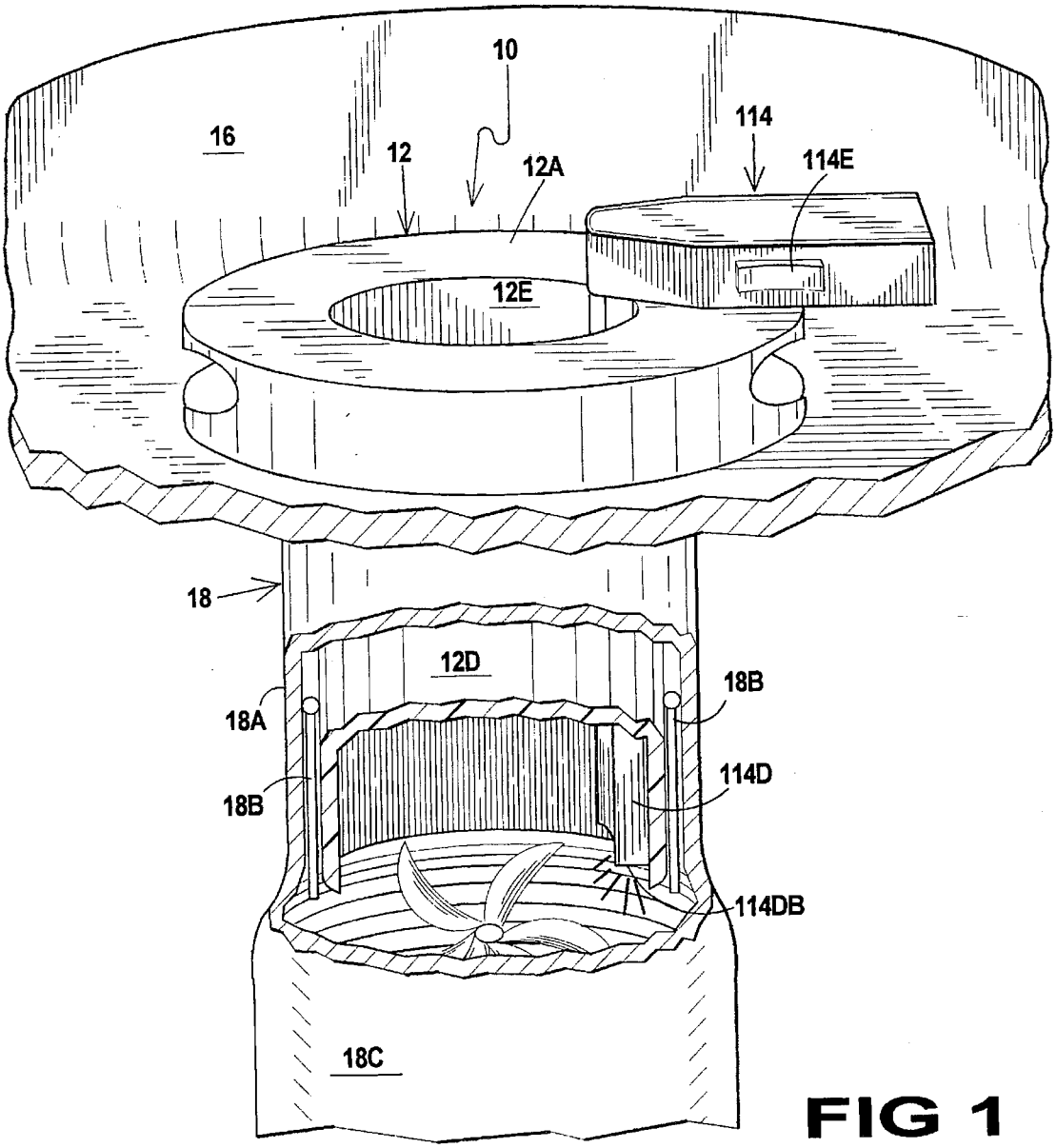
FIG. 1 is a top perspective partial cross-sectional view of a sink with a garbage disposal exhibiting a garbage disposal viewer with a first lighting means attached thereto.

Firstly, referring to FIG. 1 which is a top perspective partial cross-sectional view of a sink (16) with a garbage disposal (18) exhibiting a garbage disposal viewer (10) with a first lighting means (114) attached thereto. The first lighting means (114) rests atop of the viewer ring top (12A) with the first lighting means column (114D) inserted through a viewer ring opening (12E) into a viewer cylinder (12D). The first lighting means column (114D) shines light from a first lighting means column bottom distal end (114DB) into a garbage disposal grinder (18C) so that a user can see and remove any impediments within. The first lighting means column (114D) is inserted into the garbage disposal cylinder (18A) and concurrently forces a garbage disposal deflector (18B) into its open position. The viewer ring top (12A) is larger than the opening of the garbage disposal cylinder (18A) allowing the viewer (12) to rest atop.

Figure 2:
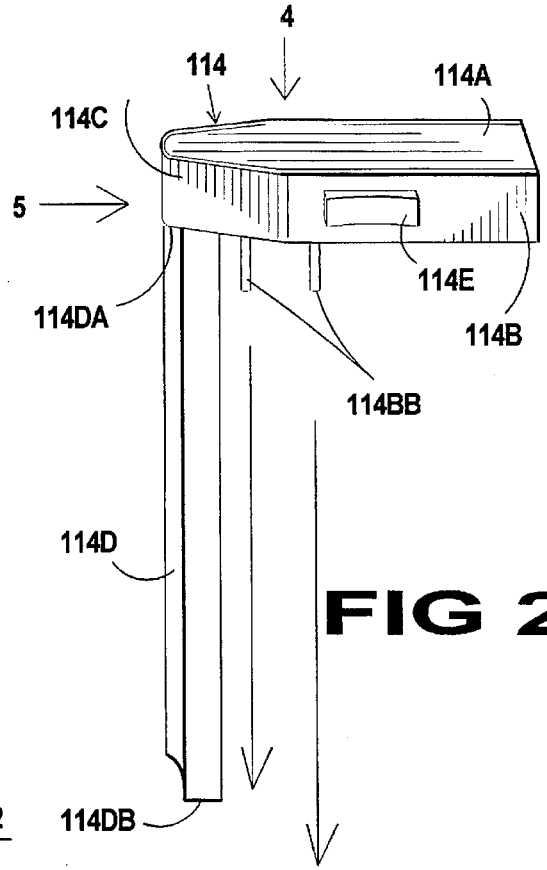
FIG. 2 is a perspective side view of a first lighting means having a first lighting means column being inserted into a viewer ring top through a viewer ring opening into a viewer cylinder.

Now referring to FIG. 2 which is a perspective side view of a first lighting means (114) having a first lighting means column (114D) being inserted into a viewer ring top (12A) through a viewer ring opening (12E) into a viewer cylinder (12D). The first lighting means (114) has a first lighting means top (114A), first lighting means side (114C) and a first lighting means bottom (114B). The first lighting means side (114C) has a first lighting means switch (114E) thereon. The first lighting means bottom (114B) has at least one first lighting means bottom male member (114BB) and a first lighting means column (114D) extending therefrom. The at least one first lighting means bottom male member (114BB) is inserted into a complimentary viewer ring top light source female member (12AA) located on the viewer ring top (12A) functioning to position and secure thereon the first lighting means (114) to the viewer (12). The first lighting means column (114D) has a first lighting means column top distal end (114DA) and a first lighting means column bottom distal end ( 114DB ). The The first lighting means column (114D) contains a plurality of first lighting means fiber optic (114G) extending from the first lighting means column top distal end (114DA) through the first lighting means column bottom distal end (114DB).

The viewer (12) has a viewer ring top (12A) with a viewer ring opening (12E) containing at least one viewer ring top light source female member (12AA) therein, a viewer ring bottom (12B), a viewer ring side (12C), and a viewer cylinder (12D). The viewer ring side (12C) has at least one viewer ring side lifter (12CA) which facilitates the insertion and removal of the garbage disposal viewer (10) into and out of the garbage disposal cylinder (18A). The viewer ring bottom (12B)rests atop of a bottom of the sink (16). The viewer ring opening (12E) has a similar inside diameter to an inside diameter of the viewer cylinder (12D). When a user inserts the viewer (12) into the garbage disposal cylinder (18A), the user can then view inside and remove debris from the garbage disposal grinder (18C). The first lighting means (114) is an optional accessory which facilitates the users in viewing into the garbage disposal grinder (18C).

Figure 3:
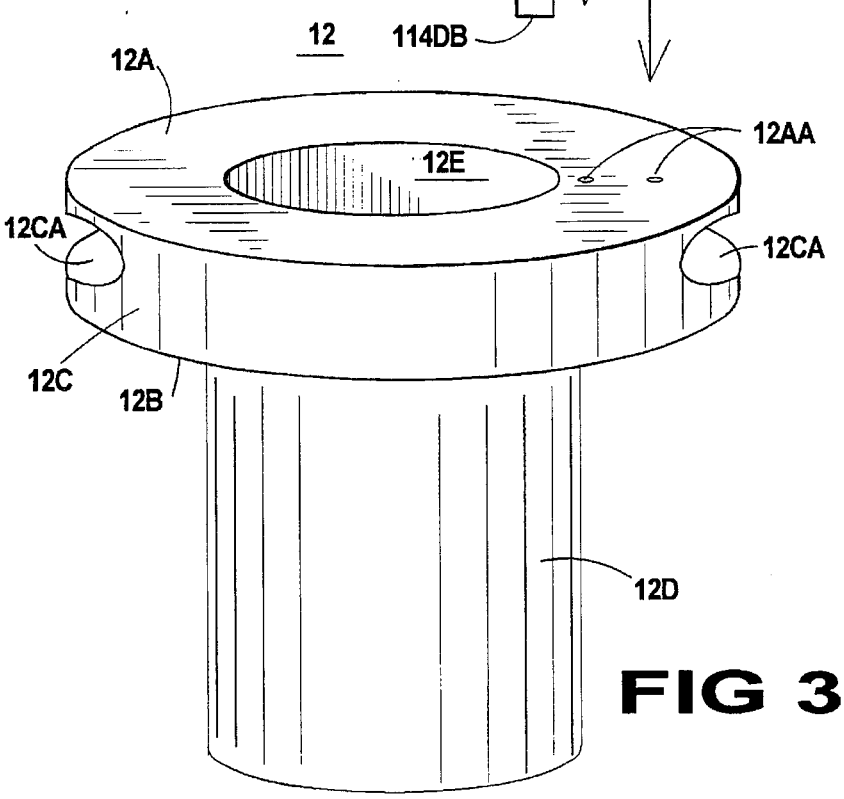
FIG. 3 is a perspective side view of a viewer exhibiting a viewer ring top having a viewer cylinder with a viewer ring opening into which the first lighting means is inserted.

Now referring to FIG. 3 which is a perspective side view of a viewer (12) exhibiting a viewer ring top (12A) having a viewer cylinder (12D) with a viewer ring opening (12E) into which the first lighting means (114) is inserted. The viewer (12) has a viewer ring top (12A), a viewer ring top (12A) with at least one viewer ring top light source female member (12AA) being complimentary to the at least one first lighting means bottom male member (114BB) extending from the first lighting means bottom (114B) functioning to position and secure thereon the first lighting means (114) to the viewer (12), a viewer ring bottom (12B) which is larger than the garbage disposal cylinder (18A) functioning to allow the viewer (12) to sit atop on the bottom of the sink (16), and a viewer ring side (12C) having at least one viewer ring side lifter (12CA) functioning to facilitate the user to remove or insert the garbage disposal viewer (10) into and out of the garbage disposal cylinder (18A).

Figure 4:
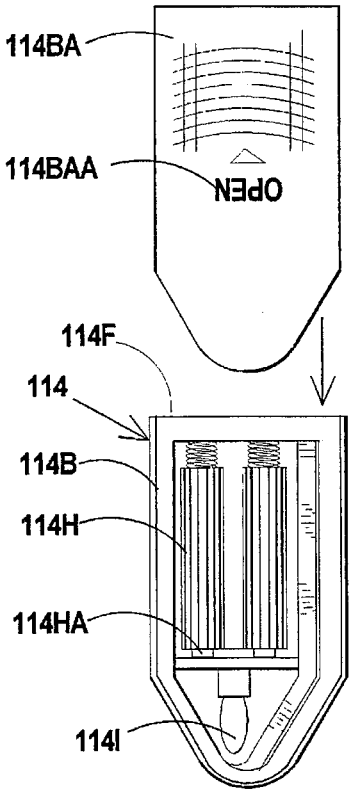
FIG. 4 is a bottom view of a first lighting means, having a first lighting means bulb and a first lighting means battery contained therein, exhibiting a first lighting means bottom lid being inserted on a first lighting means bottom.

Referring to FIG. 4 which is a bottom view of a first lighting means (114), having a first lighting means bulb (1141) and a first lighting means battery (114H) contained therein, exhibiting a first lighting means bottom lid (114BA) being inserted on a first lighting means bottom (114B). The first lighting means battery (114H) are first electronically connected to the first lighting means switch (114E) and thereafter to the first lighting means bulb (1141) by first lighting means battery electrical contacts (114HA). a user can mm ON and OFF the first lighting means bulb (1141) by utilizing the first lighting means switch (114E). The first lighting means bottom lid (114BA) has first lighting means bottom lid indicia (114BAA) preferably being the word "OPEN" and a direction arrow indication which way to "OPEN" the first lighting means bottom lid (114BA) in order to replace the first lighting means battery (114H).

Figure 5:
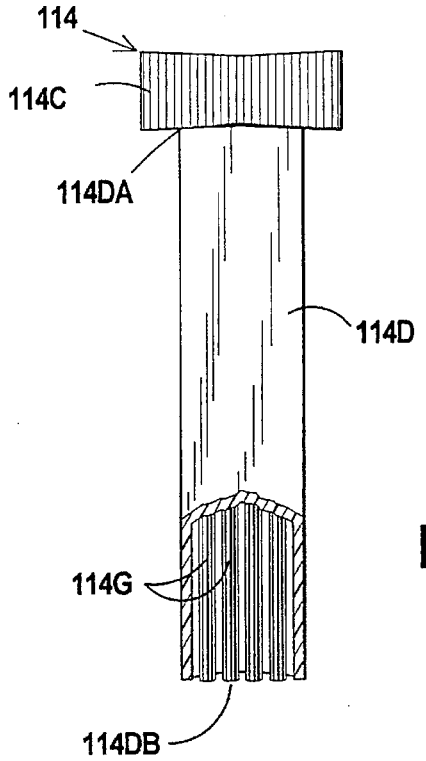
FIG. 5 is a side partial cross-sectional view of a first lighting means having a first lighting means column with a plurality of first lighting means fiber optics contained within the first lighting means column and extending from a first lighting means column top distal end to a first lighting means column bottom distal end.

Referring to FIG. 5 which is a side partial cross-sectional view of a first lighting means (114) having a first lighting means column (114D) with a plurality of first lighting means fiber optics (114G) contained within the first lighting means column (114D) and extending from a first lighting means column top distal end (114DA) to a first lighting means column bottom distal end (114DB). The first lighting means bulb (1141) illuminates at the upper distal end of the plurality of first lighting means fiber optics (114G). The light is transmitted through the first lighting means fiber optics (114G) to (and out from) the first lighting means column bottom distal end (114DB) and hence, illuminating the garbage disposal grinder (18C).

Figure 5A:
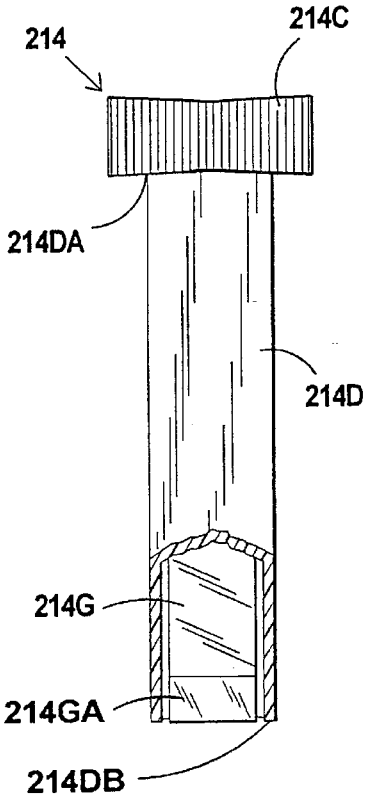
FIG. 5A is a front view of a second lighting means having a first lighting means column with a second lighting means lens exhibiting a second lighting means lens front angle extending from a second lighting means column top distal end to a second lighting means column bottom distal end.

Referring to FIG. 5A which is a front view of a second lighting means (214) having a first lighting means column (214D) with a second lighting means lens (214G) exhibiting a second lighting means lens front angle (214CA) extending from a second lighting means column top distal end (214DA) to a second lighting means column bottom distal end (214DB). a second lighting means bulb (214I) illuminates the second lighting means column top distal end (214DA) to the second lighting means column bottom distal end (214DB) which contains the second lighting means lens (214G) with the second lighting means lens front angle (214GA) functioning to direct and diffuse the light to the garbage disposal grinder (18C). Similar to the first lighting means embodiment, the second lighting means embodiment has a second lighting means top (214A), a second lighting means back (214F), and a second lighting means bottom (214B) with a second lighting means bottom lid (214BA) further comprising second lighting means bottom lid indica (214BAA) thereon. The second lighting means bottom (214B) having at least one second lighting means bottom male member (214BB) which is complimentary to the viewer ring top light source female member (12AA). The second lighting means bottom (214B) further comprises a second lighting means column (214D) having a second lighting means column top distal end (214DA) and a second lighting means column bottom distal end (214DB). A second lighting means bulb (214I) being positioned at the second lighting means column top distal end (214DA)extending light to the second lighting means column bottom distal end (214DB) containing the second lighting means lens (214G)

with the second lighting means lens front angle (214GA). The second lighting means (214) further comprises a second lighting means side (214C) having a second lighting means switch (214E) electronically connected to the second lighting means bulb (214I) and the second lighting means battery (214H) by second lighting means battery electrical contacts (214HA).

Figure 5B:
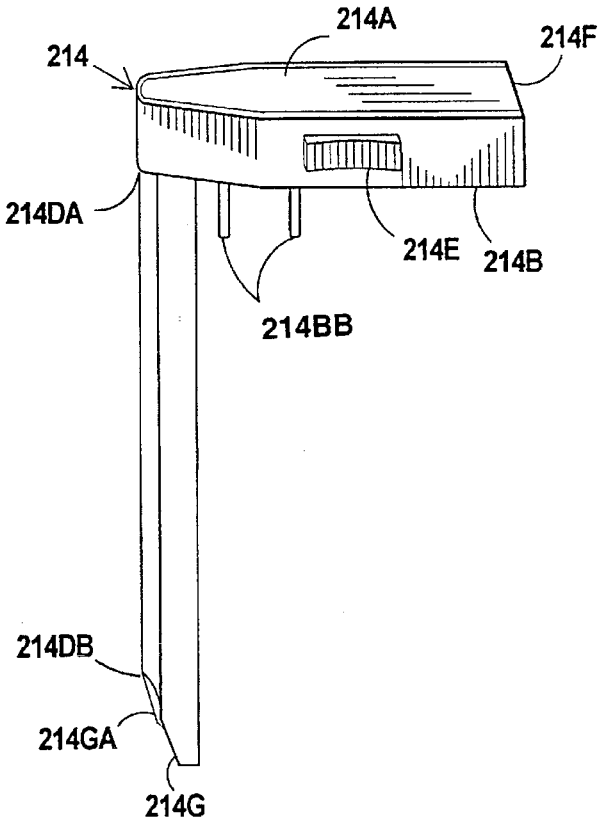
FIG. 5B is a side perspective view of a second lighting means having a first lighting means column with a second lighting means lens exhibiting a second lighting means lens front angle extending from a second lighting means column bottom distal end.

Lastly, referring to FIG. 5B which is a side perspective view of a second lighting means (214) having a first lighting means column (214D) with a second lighting means lens (214G) exhibiting a second lighting means lens front angle (214GA) extending from a second lighting means column bottom distal end (214DB). The second lighting means lens front angle (214GA) is preferably at a 45 degree angle to maximize the light directing and diffusion into and upon the garbage disposal grinder (18C).

Figure 6:
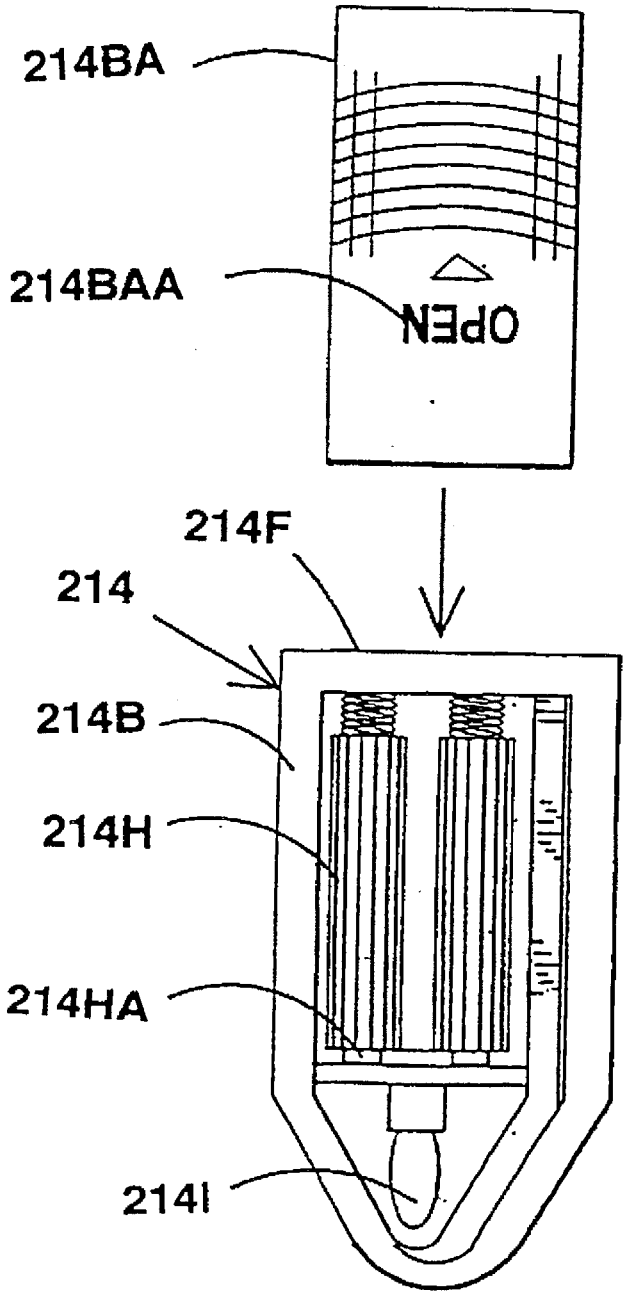
FIG. 6 is a bottom view of a second lighting means, having a second lighting means bulb and a second lighting means battery contained therein, exhibiting a second lighting means bottom lid being inserted on a second lighting means bottom.

FIG. 6 is a bottom view of a second lighting means bulb (214I) and a second lighting means battery (214H), contained therein, exhibiting a second lighting means bottom lid being inserted on a second lighting means bottom.

The scond lighting means, batteries (214H) are first electronically connected to the second lighting means battery electrical contacts (214HA). The user can turn ON and OFF the second lighting means bulb (214I) by using the second lighting means switch (214E). The second lighting means botom lid (214BA) has second lighting means bottom lid indicia (214BAA) preferably the word "OPEN" and a direction arrow indication whioch way to "OPEN" the second lighting means bottom lid (214BA) in order to replace second lighting means battery (214H).

It will be understood that each of the elements described above, or two or more together, may also find a useful application in other types of constructions differing from the type described above.

While the invention has been illustrated and described as embodied in a garbage disposal viewer, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A garbage disposal viewer (10) capable of insertion into a garbage disposal cylinder of a garbage disposal positioned within a sink, the garbage disposal viewer (10) functioning to allow an user to view a garbage disposal grinder, the garbage disposal viewer (10) comprising:

A) a viewer (12) comprises:

i) a viewer ring top (12A) comprises a viewer ring opening (12E) therein and therethrough, the viewer ring top (12A) further comprises at least one viewer ring top light source female member (12AA) therein, ii) a viewer ring bottom (12B) comprises a similar shape and size of the viewer ring top (12A), the viewer ring bottom (12B) further comprises a viewer ring opening (12E) therein and therethrough, iii) a viewer ring side (12C) circumventionally positioned around and between the viewer ring top (12B) and the viewer ring bottom (12B), and iv) a viewer cylinder (12D) extending outwardly from and securely fastened to the viewer ring bottom (12B), the viewer cylinder (12D) having sufficient length to extend beyond and thereby depress a garbage disposal deflector (18B), the viewer cylinder (12D) further comprises an outside diameter slightly smaller than an inside diameter of the garbage disposal cylinder, and v) a first lighting means (114) comprises a first lighting means top (114A), a first lighting means bottom (114B), a first lighting means side (114C), a first lighting means back (114F), a first lighting means column (114D) extending downwardly from the first lighting means bottom (114B), a first lighting means bottom male member (114BB) is complimentary to the viewer ring top light source female member (12AA), a first lighting means switch (114E) is electronically connected by first lighting means battery electrical contacts (114HA) to a first lighting means battery (114H) and electronically connected by first lighting means battery electrical contacts (114HA) to a first lighting means bulb (114I), the first lighting means column (114D) has a first lighting means column top distal end (114DA) and a first lighting means column bottom distal end (114DB), the first lighting means column (114D) further comprises a plurality of first lighting means fiber optics (114G) extending from the first lighting means column top distal end (114DA) throughout the first lighting means column (114D) to the first lighting means column bottom distal end (114DB), the plurality of first lighting means fiber optics (114G) functioning to transmit light from the first lighting means bulb (114I) to and out of the first lighting means column bottom distal end (114DB) to facilitate the user to view into the garbage disposal grinder.

2. The garbage disposal viewer (10) as described in claim 1, wherein the viewer ring side (12C) further comprises at least one viewer ring side lifter (12CA) thereon.

3. The garbage disposal viewer (10) as described in claim 1, wherein the first lighting means bottom further comprises a first lighting means bottom lid (114BA).

4. The garbage disposal viewer (10) as described in claim 1, wherein the first lighting means bottom lid (114BA) comprises a first lighting means bottom lid indicia (114BAA) printed thereon.

5. The garbage disposal viewer (10) as described in claim 4, wherein the first lighting means bottom lid indicia (114BAA) is a word, OPEN and a directional arrow.

6. The garbage disposal viewer (10) as described in claim 1 further comprises a second lighting means (214) having a second lighting means top (214A), a second lighting means bottom (214B), a second lighting means side (214C), a second lighting means back (214F), a second lighting means column (214D) extending downwardly from the second lighting means bottom (214B), a second lighting means bottom male member (214BB) complimentary to the viewer ring top light source female member (12AA), a second lighting means switch (214E) is electronically connected by second lighting means battery electrical contacts (214HA) to a second lighting means battery (214H) and electronically connected by second lighting means battery electrical contacts (214HA) to a second lighting means bulb (214I), the second lighting means column (214D) has a second lighting means column top distal end (214DA) and a second lighting means column bottom distal end (214DB), the second lighting means column (214D) further comprises a second lighting means lens (214G) with a second lighting means lens front angle (214GA) extending from the second lighting means column top distal end (214DA) throughout the second lighting means column (214D) to the second lighting means column bottom distal end (214DB), the second lighting means lens (214G) with a second lighting means lens front angle (214CA) functioning to transmit light from the second lighting means bulb (214I) to and out of the second lighting means column bottom distal end (214DB) to facilitate the user to view into the garbage disposal grinder.

7. The garbage disposal viewer (10) as described in claim 6, wherein the second lighting means bottom further comprises a second lighting means bottom lid (214BA).

8. The garbage disposal viewer (10) as described in claim 7, wherein the second lighting means bottom lid (214BA) has a second lighting means bottom lid indicia (214BAA) printed thereon.

9. The garbage disposal viewer (10) as described in claim 8, wherein the second lighting means bottom lid indica (214BAA) is a word, OPEN and a directional arrow.

* * * * *